United States Patent [19]

Johnson et al.

[11] 4,364,199

[45] Dec. 21, 1982

[54] REMOVABLE-TILT-OUT WINDOW CONSTRUCTION

[75] Inventors: William M. Johnson; Kelly L. Calhoon, both of Sioux Falls, S. Dak.

[73] Assignee: The Celotex Corporation, Tampa, Fla.

[21] Appl. No.: 167,580

[22] Filed: Jul. 11, 1980

[51] Int. Cl.[3] ..... E05D 15/22

[52] U.S. Cl. ..... 49/181; 49/453

[58] Field of Search ..... 49/181, 453, 446, 168, 49/173, 174; 16/197

[56] References Cited

U.S. PATENT DOCUMENTS

| | | | |
|---|---|---|---|
| 634,384 | 10/1899 | Weingaertner et al. | 49/173 |
| 2,778,068 | 1/1957 | Kaufman et al. | 49/181 |
| 3,055,063 | 9/1962 | Peters | 49/181 X |
| 3,108,335 | 10/1963 | Osten, Sr. | 49/181 X |
| 3,118,190 | 1/1964 | Love | 49/181 X |
| 3,124,849 | 3/1964 | Osten, Sr. | 49/181 X |
| 3,126,588 | 3/1964 | Osten, Sr. | 49/181 X |
| 3,146,501 | 9/1964 | Peters | 16/197 X |
| 3,157,917 | 11/1964 | Peters | 49/181 |
| 3,183,559 | 5/1965 | Love | 16/197 X |
| 3,184,784 | 5/1965 | Peters | 16/171 |
| 3,197,819 | 8/1965 | Trout | 49/181 X |
| 3,335,523 | 8/1967 | Isler et al. | 49/168 |
| 3,462,882 | 8/1969 | Brown, Jr. | 49/181 |
| 3,482,354 | 12/1969 | Trout | 49/181 |
| 3,789,549 | 2/1974 | Yip | 49/181 |
| 3,797,168 | 3/1974 | Trout | 49/181 |
| 3,842,540 | 10/1974 | Anderson | 49/181 |
| 4,068,406 | 1/1978 | Wood | 49/181 |
| 4,079,549 | 3/1978 | Wood | 49/181 |

*Primary Examiner*—Philip C. Kannan

*Attorney, Agent, or Firm*—James W. Grace

[57] ABSTRACT

The invention relates to a removable tilt-out window construction in which a window may be rotated 90° from its normal vertical position and such rotation causes a slidable block connected to a spring counterbalance to be locked in place to prevent violent release of the spring upon removal of the window. The invention describes a weather strip (30) having a slidable block (68) with a rotatable locking cam (90). Slidable block (68) rides on tracks (64 and 66). Locking Cam (90) can be rotated so that it forces tracks (64 and 66) against the sides of slots (110 and 112) to frictionally engage the slidable block (68) into a fixed position. A window sash (22) is connected to the locking cam (90) to provide rotation thereof to lock slidable block (68). Window 22 may be removed from engagement with locking cam (90) if desired.

12 Claims, 10 Drawing Figures

FIG. 1
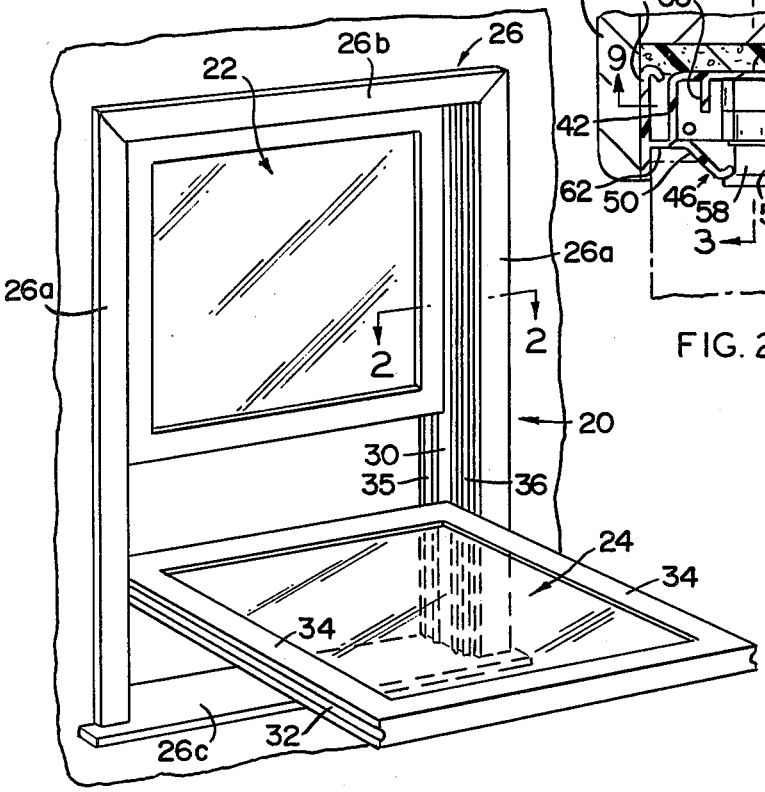
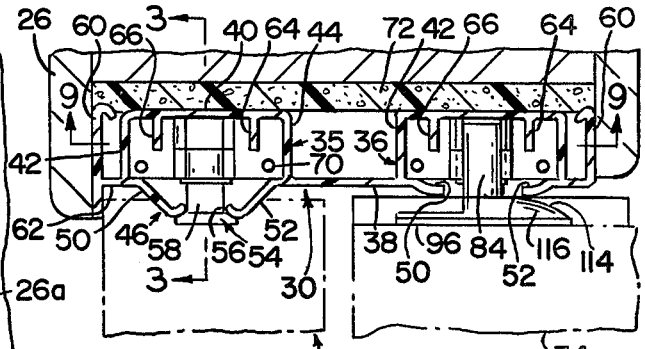
FIG. 2
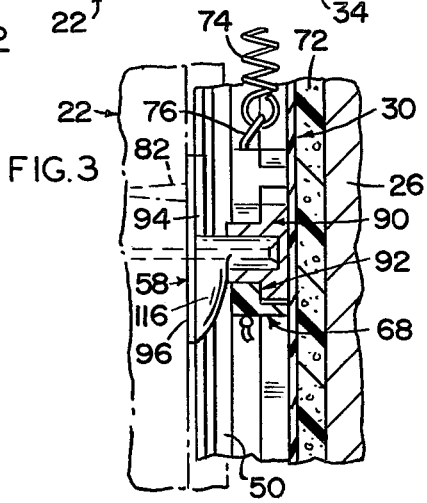
FIG. 3
FIG. 4
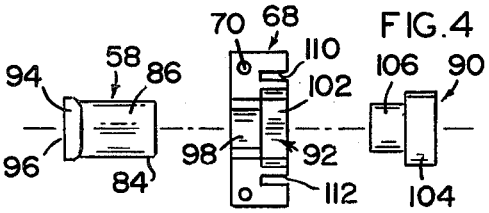
FIG. 9
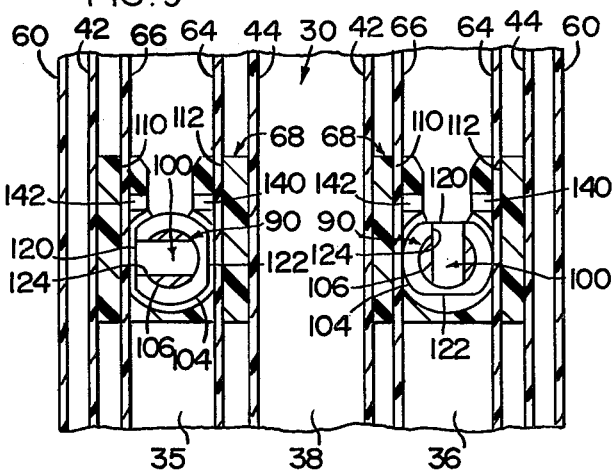
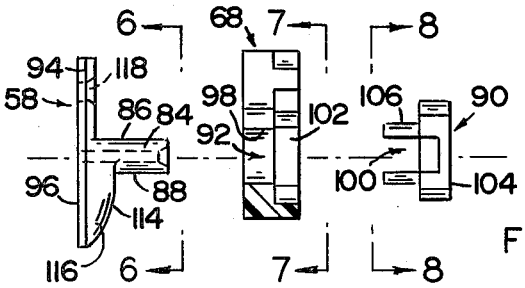
FIG. 5
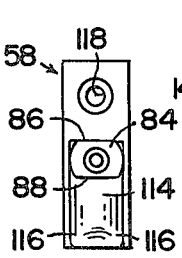
FIG. 6
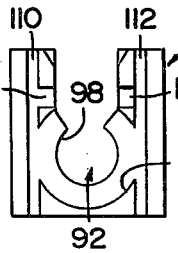
FIG. 7
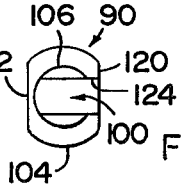
FIG. 8
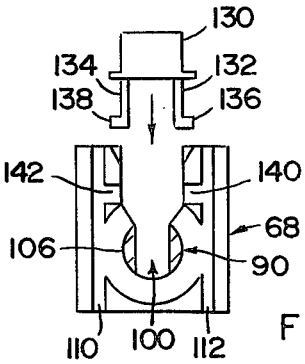
FIG. 10

REMOVABLE-TILT-OUT WINDOW CONSTRUCTION

BACKGROUND OF THE INVENTION

1. Field of the Invention

This invention is useful in the field of double hung sash windows and is of particular use where it is desired to tilt a sash window for cleaning purposes or to remove the window to replace a broken pane of glass.

2. Description of the Prior Art

The pivoted or tilt-out double hung sash window is not a new concept but has been in use for many years. Its convenience for washing the outside of the window or for replacing a broken pane of glass in high-rise buildings has made such a window structure popular. The counterbalance system for holding the sash window in its open or closed position has progressed from a lead or iron counterweight to a balance spring assembly. The balance spring mechanism is enclosed in the side jamb liners or weather strips on each side of the window sash.

One of the problems which is present in the pivoted or tilt out sash window has been the retention of the end of the counterbalance spring which is attached to or removably secured to the window itself. Since the window is removable, its full weight will not be available to offset the pull of the counterbalance spring. When the window is removed, the connection between the window sash and the counterbalance spring is disconnected and unless a positive locking arrangement is effected, there will be no force to counteract with the counterbalance spring. The counterbalance spring will snap upwardly and may, after a few such releases, be deformed so that its effectiveness may be reduced.

There are many types of locking mechanisms which are available to overcome the problems outlined above. Reference may be had to U.S. Pat. Nos. 3,055,063; 3,108,335; 3,118,190; 3,124,849; 3,183,559; 3,184,784; 3,335,523; 3,462,882; and 3,482,354. In general these patents show a locking mechanism in which a block which is connected to the window sash by a disconnectable pin or bar rides in a vertical channel. The block has an auxiliary mechanism for locking the block upon tilting of the window. In some cases a frictional engagement is made by means of a cam which has an offset center and its outer edge engages a portion of the sidewalls of the channel. In other cases the frictional engagement is made by a transverse movement of a cam which again locks the block against a portion of the cam.

A still further type of locking mechanism comprises a hook which has a sharp point to engage a wall in the side jamb liner or weather strip. However, this type of locking engagement is subject to being dislodged and the counterweight spring may be released.

For the sake of economy, rigid plastic extrusions are used as side jamb liners or weather strips which guide the window sashes in their up and down movement. However, it has been found that the rigid plastic extrusions in past configurations often do not have enough strength to act as locking elements when the window sash is to be rotated 90° from its normal position. To provide for sufficient strength for this purpose, the extruded elements would have to be made much thicker and would be more expensive.

SUMMARY OF THE INVENTION

The invention is directed to a spring-balance-mounted tilt-out sash window having a novel locking mechanism for connecting the balance spring to the sash and to the novel locking mechanism per se. The locking mechanism comprises a slidable block which has parallel spaced slots which allow the block to ride on tracks spaced in registration with the parallel spaced slots and a rotary locking cam which is engageable with the tracks to press said tracks against mating sides of said slots to effect a locking action which holds the slidable block in a fixed position when the window sash is rotated 90° from its conventional vertical position.

It is an object of the present invention to provide a spring-balance-mounted tilt-out sash window having an improved locking mechanism.

It is another object of the present invention to provide a spring-balance-mounted tilt-out sash window having a locking mechanism which permits the side jamb liners to be made of more economical semi-rigid polyvinyl or thin, flexible metal.

It is another object of the present invention to provide a novel locking mechanism for a tilt-out window which does not distort the sidewalls of the weather strip.

The novel features and objectives of the invention will become more readily apparent from a consideration of the following description taken in conjunction with the accompanying drawings in which FIG. 1 is a perspective view of the tilt-out double hung window of the invention.

FIG. 2 is a cross-sectional view of the double hung window of the invention illustrated in FIG. 1 taken along line 2—2 of FIG. 1.

FIG. 3 is a cross-sectional view of a portion of the double hung window, weather strip and jamb, illustrated in FIG. 1 taken along line 3—3 of FIG. 2.

FIG. 4 is an exploded top view of the window connector, the slidable block and the locking cam of the invention.

FIG. 5 is an exploded side elevational view of the window connector, the slidable block and the locking cam of the invention.

FIGS. 6, 7, and 8 are end views of the window connector, the slidable block and the locking cam taken along lines 6—6, 7—7, and 8—8 of FIG. 5.

FIG. 9 is an elevational view of the weather strip of the invention illustrating a slidable block in a locked and unlocked condition taken along line 9—9 of FIG. 2.

FIG. 10 is an elevation view of an slidable block, locking cam and a plug useful to prevent removal of the window.

Reference is made to the drawings and in particular to FIG. 1 in which there is shown a double-hung window generally designated 20. Window 20 includes top and bottom sashes or window units 22 and 24 which are similar in construction and which are mounted for vertical movement in opposite directions. Support frame 26 of generally rectangular construction surrounds and supports window units 22 and 24. Support frame 26 comprises opposite side jambs 26*a* forming a rigid window mounting with top and bottom cross-pieces comprised of a header 26*b* and a sill 26*c*. Support frame 26 is secured in a conventional manner in a wall of a building (not shown).

A side jamb liner or weather strip 30 is secured to the side jambs 26*a* on each side of windows 22 and 24.

Weather strip 30 is of sufficient length to span the distance between upper header 26b and sill 26c and is secured to the vertical side of frame 26 by fasteners (not shown). Side jamb liners generally have spring balances enclosed in vertical channels, the outer faces of which provide tracks upon which the windows move in their respective vertical planes. The windows have grooves 32 in the outer faces of their vertical sides or stiles 34, which engage the outer faces of the side jamb liners.

In FIG. 1, the upper window 22 is shown in its normal condition where it is free to move up and down under the guidance of the weather strips 30. The lower window 24 is shown in its tilt-out position where it is rotated at an angle of 90° with respect to the plane of the support frame 26.

With reference to FIG. 2 there is shown a cross-sectional view of the weather strip or side jamb liner 30. Weather strip 30 generally has 2 channels 35 and 36 connected by a central web 38. Since channels 35 and 36 are identical only one will be described.

Channel 35 is generally rectangular in cross-section with a back wall 40, two forwardly extending sidewalls 42 and 44 integral with said back wall 40 and a front wall 46 comprised of two outwardly extending walls 50 and 52. Walls 50 and 52 approach each other but are spaced by a predetermined gap 54 forming an elongated slot 56 through which window connector 58 can extend. Slot 56 extends the full length of weather strip 30. A wall 60 is offset parallel to wall 42 and spaced therefrom but connected thereto by a strip 62. Wall 60 forms a seal with the frame 26.

A pair of ribs or tracks 64 and 66 are integral with rear wall 40 and project toward front wall 46. Tracks 64 and 66 are spaced a preset distance from each other and from side walls 42 and 44. Tracks 64 and 66 form tracks on which slidable block 68 slides up and down within channel 34. Slidable block 68 has a hole 70 (better shown in FIG. 4) extending through its length for receiving a string or cord which is attached to a spring.

In order to seal the window frame against infiltration of air and dust, a foam plastic resilient pad 72 is inserted between the back of weatherstrip 30 and the frame 26. Foam plastic pad 72 may be of resilient foam plastic such as foamed urethane or isocyanurate.

A cross-sectional side view of the invention may be seen in FIG. 3 in which foam plastic resilient pad 72 separates frame 26 from weather strip 30. Slidable block 68 is connected to a spring 74 by means of a string 76 which extends through hole 70 (See FIG. 4) and is knotted at the bottom of the hole. The other end of spring 74 may be secured to any convenient part of weather strip 30. In this figure, spring 74 is shown as a simple coil spring as a replacement for lead sash weights. Spring 74 may be replaced by a conventional block and pulley system if desired. For heavy windows more than one spring may be used.

The side rail 34 of window sash 22 has connector key 58 connected thereto by a screw 82. A projecting key portion 84 which may be in the shape of an oval having flat top and bottom faces 86 and 88 is inserted into a corresponding slot in a rotatable cam 90 which in turn is designed to rotate within a cylindrical bore 92 extending through the thickness of slidable block 68.

For more detailed views of the window connector 58, slidable block 68 and rotatable cam 90 reference may be had to FIGS. 4–8.

FIG. 4 is an exploded top view of window connector 58, slidable block 68 and rotatable cam 90. Window connector 58 has an upwardly extending portion 94 (better seen in FIG. 5) having flat face 96 which is held against the side of window 22 by a screw (not shown in this Figure). A projecting key portion 84 extends outwardly away from the portion 94 and is designed to project through a cylindrical bore 98 in slidable block 68 into engagement with a corresponding slot 100 in rotatable cam 90.

Slidable block 68 has a bore 92 which comprises two concentric cylindrical bores 98 and 102 of which bore 98 is of lesser diameter. Bores 98 and 102 are designed to accept rotatable cam 90 which has a cylindrical portion 104 and a smaller cylindrical portion 106 projecting from portion 104. Cylindrical portion 104 of cam 90 fits into bore 102 of slidable block 68 while cylindrical portion 106 fits into bore 98 of slidable block 68.

Slidable block 68 also has two slots 110 and 112 running parallel to each other and spaced so that they ride on tracks 64 and 66 of channel 35.

With reference to FIG. 5, there is shown a side elevational view of connector key 58 showing upwardly extending portion 94, flat face 96 and projecting key portion 84. In addition, the lower portion of connector key 58 has an arcuate face 114 which has beveled sides 116 to form a cam surface which operates when the window is tilted at 90° from its upright position. This camming action permits the window to be released from its guide track arrangement when vertical side or stile 34 along with arcuate face 114 of connector key 58 engages and compresses the outermost tips of outwardly extending walls 50 and 52 of front wall 46. In FIG. 2, it is clear that window sash 34 (shown in phantom) is displaced further away from weather stripping 30 than is window sash 22 (shown in phantom). This displacement is caused by the cam surface of arcuate face 114 of key 84. A hole 118 is drilled through upstanding portion 94 of connector 58 to receive a screw to secure connector 58 to window 22.

FIG. 5 also illustrates a side elevational view of slidable block 68 showing bores 98 and 102.

Rotating cam 90 is shown in FIG. 5 in a side elevational view showing cylindrical portion 104 and smaller cylindrical portion 106 of cam 90 with slot 100 which accommodates projection 84 of connector key 58.

FIG. 6 illustrates a front face elevational view of connector key 58 with upright portion 94, projecting portion 84, arcuate face 114 and beveled portions 116 of arcuate face 114. Hole 118 in upright portion 94 is also shown.

FIG. 7 shows a rear elevational view of the slidable block 68 illustrating larger bore 102 leading into smaller bore 98, slots 110 and 112. It is apparent that bore 102 opens into slots 110 and 112.

FIG. 8 shows a front elevational view of rotatable cam 90 having a rear partially cylindrical portion 104 with flat sides 120 and 122.

The operation of the locking mechanism of the present invention can best be understood by reference to FIG. 9 which shows a portion of weather strip 30 with channel 35 on the right and channel 36 on the left. It will be assumed that the window connector 58, slidable block 68, and rotatable cam 90 have been assembled with rotatable cam 90 being inserted into slidable block 68. Cylindrical portion 106 of cam 90 fits into bore 98 of slidable block 68 and cylindrical portion 104 of cam 90 fits into bore 102 of slidable block 68. The thickness of cam 90 is the same as the thickness of slidable block 68.

The projecting key portion 84 of window connector 58 is inserted into slot 100 of cam 90.

It is to be understood that when window unit 22 is in its vertical position cam 90 lies inside slidable block 68 so that the flat sides 120 and 122 of cam 90 are aligned with the slots 110 and 112 of slidable block 68, as shown in FIG. 9. Thus, slidable block 68 is free to move up and down on tracks 64 and 66.

When window 24 is rotated at 90° with respect to its vertical position, cam 90 is also rotated by virtue of its connection with window connector 58 so that now the flat sides 120 and 122 of cam 90 are out of line with tracks 64 and 66 and the cylindrical wall of the lower cylindrical portion 104 of cam 90 is forced into engagement with tracks 64 and 66 trapping the tracks 64 and 66 against the sides of slots 110 and 112 of slidable block 68. In this position slidable block 68 is held rigidly in position and the spring counterbalance cannot overcome the frictional force holding slidable block 68.

Slot 100 has an opening 124 which permits removal of window 24 from engagement with cam 90 by providing an unobstructed path so that projecting key portion 84 of window connector 58 can be removed from engagement with slot 100 of rotatable cam 90.

When window unit 24 is again rotated 90° from its horizontal position to its more normal vertical position, rotating cam 90 rotates 90° to disengage the round surfaces of cam 90 from engagement with tracks 64 and 66 and permits the flat surfaces 120 and 122 of rotatable cam 90 to face the inside surfaces of tracks 64 and 66 thus giving clearance for sliding block 68 to move freely up and down as the window is moved up and down in its vertical plane.

FIG. 10 illustrates a locking plug 130 which can be used to close opening 124 of slot 100 of cam 90 if it is desired to prevent removal of window 24. Plug 130 has depending feet 132 and 134 with outwardly extending fingers 136 and 138. Slidable block 68 has receiving grooves 140 and 142 which will receive fingers 136 and 138 of locking plug 130 and close channel 100 to prevent removal of window 24.

While the tilt-out feature has been described with respect to the lower window unit 24, it should be understood that the same operation applies equally to the upper window unit 22.

Although the operation of the invention has been described with respect to two tracks 64 and 66, it should be understood that, if desired, only one such track may be necessary.

I claim:

1. A window jam weather strip comprising at least one channel, said channel having a back wall, spaced apart sidewalls and a front wall, said front wall having an elongated slot throughout its length, at least one track integral with and extending perpendicularly away from said backwall toward said front wall in spaced parallel relationship with respect to one of said sidewalls; a slidable block having at least one slot extending the length of said slidable block through one face thereof, said slidable block being positioned within said channel so that said slot is astride said track, said slidable block further having a central opening; a locking cam rotatably positioned in said central opening of said slidable block, said locking cam being moveable into and out of engagement with said track so as to press said track into locking engagement with one side of said slot whereby said slidable block can be held fixedly in place with respect to said weather strip.

2. A window jamb weather strip as recited in claim 1 in which said channel has two spaced parallel tracks integral with and extending perpendicularly away from said backwall toward said front wall in spaced parallel relationship with respect to one of said sidewalls and said slidable block has two slots extending the length of said slidable block through one face thereof, said sliding block being positioned within said channel so that each of said slots is astride a respective one of said tracks.

3. A window jamb weather strip as recited in claim 1 in which said back wall of said channel has a resilient pad secured to the side of said back wall opposite said front wall.

4. A window jamb weather strip as recited in claim 1 in which said central opening of said slidable block comprises two cylindrical bores of different diameters and said locking cam comprises a partially circular portion with at least one flat chord surface and a smaller cylindrical portion extending away from said partially circular portion, and in which said partially circular portion of said locking cam is rotatably positioned in one of cylindrical bores of said slidable block.

5. A window jamb weather strip as recited in claim 1 in which said channel further has a spring connected to said channel and said slidable block.

6. A window jamb weather strip as recited in claim 1 in which said central opening of said slidable block has a unobstructed opening, and a plug means adapted to connect to said slidable block to close said unobstructed opening.

7. A window jamb weather strip comprising two parallel channels, means connecting said channels in fixed spaced parallel relationship, each of said channels having a back wall, spaced apart sidewalls and a front wall, said front wall of each channel having an elongated slot throughout its length, at least one track in each of said channels, said track being integral with and extending perpendicularly away from said backwall toward said front wall in spaced parallel relationship with respect to one of said sidewalls; a slidable block in each channel having at least one slot extending the length of said slidable block through one face thereof, said slidable block being positioned within said channel so that said slot is astride said track, said slidable block further having a central opening; a locking cam being rotatably positioned in said central opening of said slidable block, said locking cam being moveable into and out of engagement with said track so as to press said track into locking engagement with one side of said slot whereby said slidable block can be held fixedly in place with respect to said weather strip.

8. In a tilt-out sash window comprising a frame including side jambs, at least one sash having side stiles, weather stripping secured to each of said side jambs, said weather stripping being shaped to receive said window stiles in slidable engagement, a longitudinal channel in said weather stripping on each side of said sash window, said channel having a back wall, spaced sidewalls and a front wall, at least one track integral with and extending perpendicularly away from said backwall toward said front wall in spaced parallel relationship with one of said sidewalls and a balance spring locking mechanism comprising:

a slidable block in each of said longitudinal channels, said slidable block having at least one slot extending the length of one side of said slidable block through one face thereof said slidable block being positioned within said channel so that said slot is astride said track, said slidable block further having a central opening, a locking cam rotatably mounted in said central opening of said slidable block, spring means attached to said channel and said slidable block said locking cam being moveable into and out of engagement with said track so as to press said track into locking engagement with one side of said slot whereby said slidable block can be held fixedly in place with respect to said weather strip.

9. In a tilt-out sash window as recited in claim 6 in which said locking cam has a slot therein, said slot having flat sides, and being adapted to receive a key, and said sash has affixed thereto a key capable of insertion into said slot for rotating said locking cam.

10. A window jamb weather strip as recited in claim 9 in which said key has bevelled faces abutting said front wall of said slidable block.

11. In a tilt-out sash window as recited in claim 8 in which said back wall of said channel has a resilient pad secured to the side of said back wall opposite said front wall.

12. In a tilt-out sash window comprising a frame including side jambs, at least one sash having side stiles, weather stripping secured to said side jambs, said weather stripping being shaped to receive said window stiles in slidable engagement, a longitudinal channel in said weather stripping on each side of said sash window and a balance spring in each said channel;

a balance spring locking mechanism comprising;

a slidable block in said longitudinal channel; said slidable block having a first circular opening extending inwardly from a first face of said block, said block further having a second circular opening of greater diameter than said first circular opening extending inwardly from the faces of said block opposite said first face, said openings meeting each other centrally of the thickness of said block, said slidable block further having spaced wall means forming a pair of longitudinal slots extending from one end of said block to the opposite end of said block and forming the outer limits of said second circular opening, a rotatable locking cam having a first portion of a preset diameter and a second portion of greater diameter than said first portion, said rotatable cam being adapted to fit into said first and second circular openings, a pair of upstanding tracks attached to said weather stripping and being aligned with said slots, spring means attached to said weather stripping and to said block, means adapted to connect said window sash with said rotatable locking cam member to move said cam member from a first locked position in engagement with said track to a second unlocked position out of engagement with said tracks, whereby said block may be locked in a present location with respect to said side jamb.

* * * * *